US007289073B2

(12) United States Patent
Song et al.

(10) Patent No.: US 7,289,073 B2
(45) **Date of Patent: *Oct. 30, 2007**

(54) METHOD FOR IMPROVING THE EFFICIENCY OF TRANSPARENT THIN FILM ANTENNAS AND ANTENNAS MADE BY SUCH METHOD

(75) Inventors: Hyok J. Song, Los Angeles, CA (US); Tsung Yuan Hsu, Westlake Village, CA (US); Daniel F. Sievenpiper, Santa Monica, CA (US); Timothy J. Talty, Beverly Hills, MI (US); Hui-Pin Hsu, Northridge, CA (US)

(73) Assignee: GM Global Technology Operations, Inc., Detroit, MI (US)

( * ) Notice: Subject to any disclaimer, the term of this patent is extended or adjusted under 35 U.S.C. 154(b) by 49 days.

This patent is subject to a terminal disclaimer.

(21) Appl. No.: 11/208,211

(22) Filed: Aug. 19, 2005

(65) Prior Publication Data

US 2007/0040746 A1 Feb. 22, 2007

(51) Int. Cl.
*H01Q 1/32* (2006.01)

(52) U.S. Cl. ..... 343/713; 343/711

(58) Field of Classification Search ..... 343/713, 343/711, 712, 705, 708, 767, 768, 769
See application file for complete search history.

(56) References Cited

U.S. PATENT DOCUMENTS 4,063,246 A 12/1977 Greiser
5,353,038 A * 10/1994 Osborne et al. ..... 343/708
5,355,144 A * 10/1994 Walton et al. ..... 343/713
5,926,141 A 7/1999 Lindenmeier et al. ..... 343/713
6,097,345 A * 8/2000 Walton ..... 343/769
6,329,950 B1 * 12/2001 Harrell et al. ..... 343/700 MS
6,417,811 B1 7/2002 Adrian
6,606,062 B2 8/2003 Ngounou Kouam et al.

OTHER PUBLICATIONS

R.N. Simons and R. Q. Lee, "Feasibility Study of Optically Transparent Microstrip Patch Antenna", IEEE Antennas and Propagation Society International Symposium 1997 Digest, Montreal, Quebec, Jul. 14-18, vol. 4, 1997, pp. 2100-2103.
K. Oshima et al., "Use of a Transparent Conductive Thin-film on a Glass Substrate in Active Integrated Antenna Arrays with Double Strong Coupling", IEEE MTT-S Digest, 2002, pp. 1569-1572.
Simons et al., "Finite Width Coplanar Waveguide Patch Antenna with Vertical Fed Through Connect", NASA Technical Memorandum 107136, prepared for 1996 IEEE AP-S International Symposium and URSI Radio Science Meeting Cosponsored by IEEE, AP-S, and U.R.S.I., Baltimore, Maryland, Jul. 16-21, 1996, pp. 1-6.

* cited by examiner

*Primary Examiner*—Hoanganh Le

(57) ABSTRACT

A method for improving the efficiency of antennas having transparent thin-film conductive surfaces, and antennas improved by the method are disclosed. For a selected frequency of antenna operation, values for surface current density in areas distributed over the surface of the thin-film are determined. Regions of the surface containing areas having concentrated current flow are identified based upon the determined values of current density. Antenna efficiency is improved by increasing conductivity in areas of the thin-film surface found to have concentrated current flow. The method enables the improvement of the efficiency of antennas having transparent thin-film conducting surfaces, without unnecessarily obstructing the optical view through the thin-film surfaces of the antennas.

11 Claims, 5 Drawing Sheets

METHOD FOR IMPROVING THE EFFICIENCY OF TRANSPARENT THIN FILM ANTENNAS AND ANTENNAS MADE BY SUCH METHOD

CROSS-REFERENCE TO RELATED APPLICATIONS

This application is related to U.S. patent application Ser. No. 11/207,512 entitled "TRANSPARENT THIN FILM ANTENNA" filed on even date herewith and incorporated herein by reference.

TECHNICAL FIELD

The present invention is related to thin-fihm antennas, and more particularly to a method for improving the efficiency of antennas having surfaces formed of transparent thin-film conducting material, and antennas made by such method.

BACKGROUND OF THE INVENTION

The use of thin-film antennas has been gaining popularity in recent years. Thin-film antennas are generally formed by applying a thin layer of conductive material to sheets of plastic film such as polyester, and then patterning the resulting sheets to form the conductive surfaces of antennas. Alternatively, conductive material may also be deposited on plastic or other dielectric sheets in desired patterns to form the antennas with the use of well-known masking and deposition techniques.

One area where there has been increased interest in using such thin-film antennas is for window-mounted applications in motor vehicles, aircraft, and the like. Due to the increasing need for different modes of wireless communication, thin-film window antennas represent a desirable alternative to populating a vehicle or aircraft structure with mast or other non-conformal type antennas, which can detract from the aerodynamic and aesthetic appearance of the surface.

Of course, the transparency of window-mounted thin-film antennas is an important consideration. To be useful as an optically transparent antenna, it is desirable that an antenna's transmittance to visible light be no less than about 70%. There are trade-offs between the optical transparency and the conductivity (or surface resistance) of thin-films utilized to make such antennas. For example, copper films having a surface resistance of about 0.25 milliohms/square are commercially available, but their transparency is well below the desired level of 70%. Other commercially available thin-films formed from conductive materials such as indium tin oxide (ITO) or silver have acceptable transparencies (for example, AgHT™ silver type films have optical transparencies greater than 75%), but such films have surface resistances in the range of 4-8 ohms/square, which is several orders of magnitude greater than that of the above copper films, or conventional conductors used for antenna construction. When transparent thin-films having these higher surface resistances are used as the conductive surfaces for an antenna, the performance of the antenna is diminished. Antenna efficiency is reduced due to ohmic loss in the higher resistance films, and as a result, antenna gain can be reduced by as much as 3-6 dB, depending upon the type of antenna.

In the past, attempts have been made to improve the efficiency of transparent thin-film antennas by increasing the conductivity of the surface. This is typically accomplished by increasing the thickness or type of conductive material applied, or by placing relatively thick sheets of non-transparent highly conductive material on the antenna. In doing so, the antennas become non-transparent. Without knowing the exact nature of the currents flowing on the surface of the thin-film antenna, the size of the areas where conductivity is increased can be made too large, thereby unnecessarily obstructing the optical view through a transparent antenna, or if areas of high current flow are not recognized and made more conductive, the resulting antenna will have a lower efficiency that could have otherwise been achieved.

Therefore, a need exists for a reliable method for improving the efficiency of antennas having transparent thin-film conducting surfaces, without unnecessarily obstructing the optical view through such surfaces.

SUMMARY OF THE INVENTION

The present invention provides a method for improving the efficiency of an antenna having a surface formed of a transparent thin-film conducting material. Broadly, the method comprises: (a) determining values for current density distributed over areas of the surface of the transparent thin-film conducting material in which current flows as a result of operation of the antenna at a selected frequency; (b) identifying areas of the surface having concentrated current flow based on the determined values for current density; and (c) increasing surface conductivity in a portion of the areas of the surface identified as having concentrated current flow, thereby reducing ohmic loss and increasing antenna efficiency.

The values for current density distributed in areas over the surface of the transparent thin-film conducting material are preferably determined by computing simulated current flow in the surface using a computer program. Wire grid structures are used to model the antenna, and a simulated source of electromagnetic excitation is applied to the wire grid structures to excite simulated current flow in wire segments forming the wire grid structures. Values of current density in areas distributed over the surface formed of the transparent thin-film conducting material are preferably determined by obtaining a numerical solution to Maxwell's equations based upon a method of moments (MoM) technique.

Areas of the surface having concentrated current flow are then identified by mapping the surface of the transparent thin-film conducting material into regions containing different non-overlapping ranges of values for the current densities. Accordingly, the regions containing areas having the larger values of current density identify areas of the surface having concentrated current flow.

Once the areas having concentrated current flow are identified, portions of one or more of these areas are overlaid with an electrically conductive material to increase the surface conductivity, thereby reducing ohmic loss to improve the efficiency of the antenna.

By determining values for current density in areas distributed over the entire surface of the thin-film, the areas having concentrated current flow can be identified easily. As a result, areas of the surface where conductivity is increased can be limited to the regions identified as having higher magnitudes of current density. Since areas where conductivity is increased become less transparent, the present method enables antenna efficiency to be increased in a more optimal and selective fashion, without unnecessarily obstructing the optical view through the thin-film surface of the antenna.

The present invention also includes antennas having improved efficiency resulting from the application of the above method. The efficiency of antennas having surfaces formed of transparent thin-film conducting material are improved by overlaying electrically conductive material over portions of areas of the surface identified as having concentrated current flow. Therefore, ohmic loss in the surface can be selectively reduced to improve antenna efficiency, without undesirably obstructing the optical view through the antenna.

BRIEF DESCRIPTION OF THE DRAWINGS

The present invention will now be described, with reference to the accompanying drawings, in which.

DESCRIPTION OF THE PREFERRED EMBODIMENT

Figure 1:
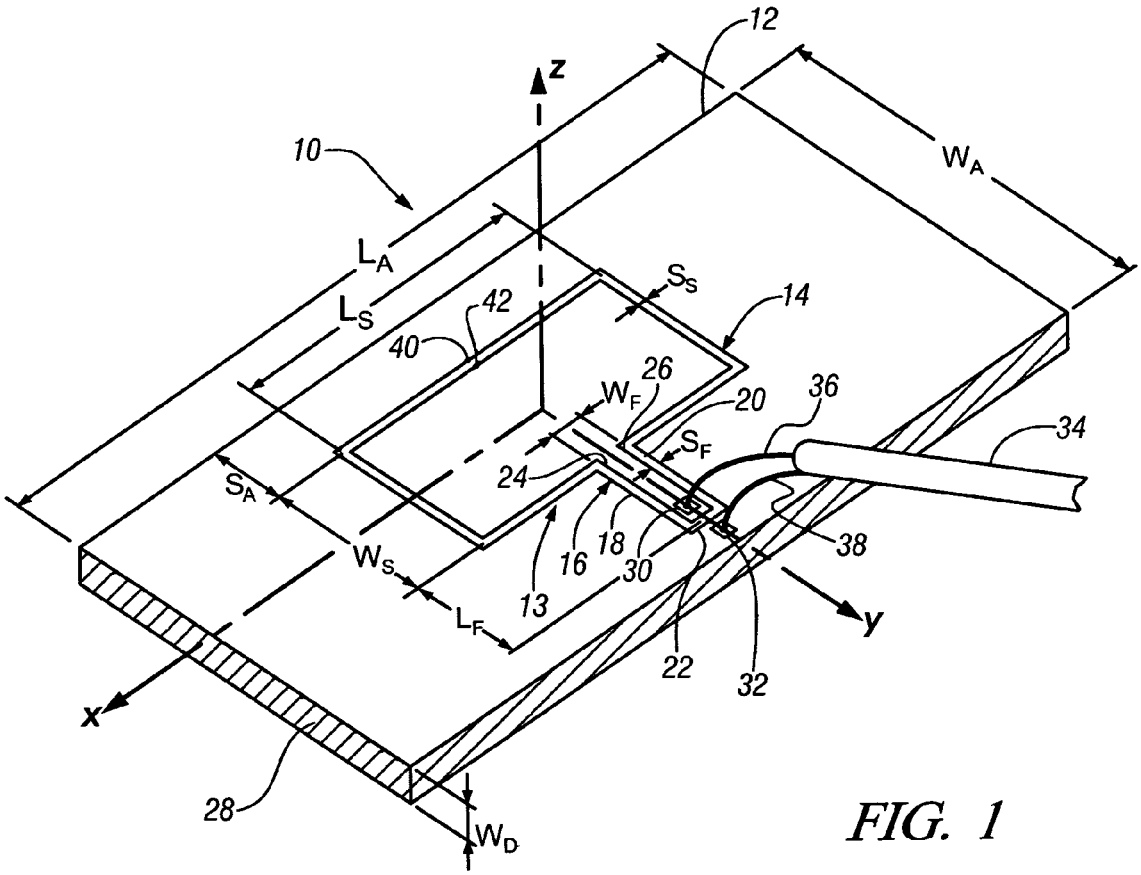
FIG. 1 shows a perspective view of a transparent thin-film antenna used to demonstrate the method of the present invention.

Turning now to the drawings, and referring first to FIG. 1, there is shown in diagram form, a perspective view of a thin-film antenna, generally designated as 10, which will be used to demonstrate the method of the present invention. It should be noted that use of antenna 10 is intended only to be exemplary, as the method of the present invention can be applied to thin-film conducting surfaces of antennas having different forms and structures.

The thin-film antenna 10 is comprised of a sheet of transparent thin-film conducting material 12, having an aperture formed in its surface by the closed continuous slot designated generally by 13. The closed continuous slot 13 is comprised of two connected slot portions, a rectangular shaped slot portion designated generally by 14, which connects to a substantially U-shaped slot portion designated generally by 16. The slot of the U-shaped portion 16 is comprised of two essentially parallel slot sections 18 and 20, each connected to a base slot section 22. The slot of the rectangular shaped portion 14 has two ends 24 and 26, near the middle of one of its longer sides, each of which opens outwardly to connect with a different one of the two parallel slot sections 18 and 20 of the U-shaped slot portion 16. The sheet of thin-film conducting material 12 is shown disposed on a layer of non-conducting dielectric material 28.

For coupling electromagnetic energy into and out of antenna 10, feed points 30 and 32 are formed on the sheet of thin-film material 12. The feed points 30 and 32 are located on opposing sides of the base slot section 22, proximate to the edges of its slot. For purposes of illustration, a coaxial cable 34 is shown as having a center conductor 36, and a shield or outer conductor 38, respectively connected to antenna feed points 30 and 32. Coaxial cable 34 provides the means for exciting current flow in the surface of the transparent thin-film conducting material 12, when antenna 10 operates to transmit electromagnetic energy, and for collecting current flowing from the surface of the thin-film conducting material 12, when antenna operates to receive electromagnetic energy.

Techniques for fabricating thin-film antennas such as the one illustrated in FIG. 1 are well known in the art. For example, any number of commercially available thin conductive films may be used as the sheet of transparent thin-film conductive material 12. For the present embodiment, AgHT™-4 type film was used. This film can be purchased from Instrument Plastics Limited, and is manufactured by vapor depositing a coating of conductive silver alloy onto thin sheets of optical grade polyester film, which is pliable and available in varying thickness (12 to 250 microns). The resulting AgHT™-4 film has a surface resistance of about 4.5 ohms/square, a transparency to visible light of at least 75%, and can easily be cut and formed into desired shapes.

The sheet of transparent thin-film conducting material 12 of antenna 10 was formed from a piece of the AgHT™-4 type film by cutting it into a rectangle shape having a Length $L_A$ of about 160 mm, and a width $W_A$ of about 115 mm as illustrated in FIG. 1. Next, the cut piece of AgHT™-4 type film was attached to a layer of dielectric material 28 by adhesive. In this embodiment, the dielectric material 28 was a sheet of transparent Plexiglas™ having a relative dielectric constant $\epsilon_r$ of approximately 4.5, and a thickness $W_D$ of about 6.0 mm, which closely approximated the dielectric characteristics of automobile windshield glass.

Closed continuous slot 13 was formed in the sheet of thin-film conducting material 12 by cutting away a portion of the sheet to form an aperture having the shape of closed continuous slot 13. Of course, the slot aperture can also be formed by placing the appropriate mask on the polyester film prior to depositing the conductive material, or by use of an etching process to selectively remove the conductive material from the slot aperture, while protecting the remainder of the surface with a mask. Such techniques are well known in the art.

The rectangular shaped slot portion 14 had a length $L_S$ of about 90 mm, and a width $W_S$ of about 60 mm, and was offset from the outer edge of the sheet of thin-film material 12 by a distance $S_A$ of about 21 mm. The two parallel slot sections 18 and 20 of the U-shaped slot portion 16, each have a length $L_F$ of about 31.5 mm, while the length $W_F$ of the base slot section 22 was about 9.8 mm The width $S_S$ of the slot in the rectangular portion 14 was approximately 2.0 mm, while the width $S_F$ of the slot in the U-shaped portion 16 was approximately 1.0 mm. With regard to the above dimensions, all the measurements relative to the closed continuous slot 13 were taken from the center of its slot, except for the slot widths $S_S$ and $S_F$.

Feed points 30 and 32 can be formed on the thin-film conducting surface 12 by attaching small copper pads using conductive adhesive. The copper pads facilitate soldering of the cable conductors 36 and 38 to make electrical contact with the thin-film conducting surface 12. Those skilled in the art will also recognize that electrical contact between coax cable 34 and thin-film conducting surface 12 can also be accomplished by means of a cable connector soldered directly to the copper pads forming feed points 30 and 32.

The operation of antenna 10 will now be discussed in terms of its use as a transmitter of electromagnetic energy. It is well known that under the principle of reciprocity, the operating characteristics of an antenna, such as efficiency, radiation patterns, and the like, are the identical for an antenna operating as either a transmitter or receiver of electromagnetic energy.

When a source of electromagnetic energy varying at a selected frequency $f_A$ is applied to propagate down coaxial cable 34 toward antenna 10, a varying potential difference at frequency $f_A$ is established across the antenna feed points 30 and 32. Current varying at frequency $f_A$ then flows through the coaxial cable conductors 36 and 38, to and from the surface of the transparent thin-film conducting material 12. As a result, electromagnetic waves propagate away from the feed points 30 and 32, in opposite directions along a transmission line path defined by closed continuous slot 13. The electric fields associated with the two opposite traveling waves are equal in magnitude at points designated as 40 and 42 along closed continuous slot 13, since the waves have traveled the same distance, but in opposite directions, along closed continuous slot 13. As a result, these fields are additive at points 40 and 42, and the standing wave in closed continuous slot 13 will always have a maximum value of its associated electric field across the slot at these points. The designated points 40 and 42 are located at the midpoint of the length of slot making up a side of the rectangle defining rectangular slot portion 14, which is furthest from the feed points 30 and 32.

Generally, antennas are operated near resonance to maximize the radiation of electromagnetic energy. For the configuration of antenna 10, a particularly useful resonance occurs when $L_C=5\lambda_g/2$, where $\lambda_g$ represents the guide wavelength of waves propagating along closed continuous slot 13 in the presence of the dielectric layer, and $L_C$ represents the effective distance traveled by an electromagnetic wave in making one complete trip around closed continuous slot 13.

For a given antenna operating frequency, the addition of the layer of dielectric material 28 to antenna 10 has the known effect of reducing the velocity of wave propagation along the closed continuous slot 13, and the guided wavelength $\lambda_g$, as compared to the wavelength in free space $\lambda_o$ without the dielectric layer 28. This relationship is given approximately by $\lambda^g=\lambda_o/(\text{square root of } \epsilon_r)$. This has the effect of also decreasing the frequency at which antenna 10 resonates. For the previously described dimensions of the closed continuous slot 13, antenna 10 would have a resonance of about 2.0 GHz, without the Plexiglas™ layer of dielectric material 28. With the dielectric material 28 present, the resonant frequency shifts down to about 1.0 GHz.

Advantages also result when the dimensions $L_S$ and $W_S$ of the rectangle defining the rectangular slot portion 14 are such that $L_S+W_S=\lambda_g$. This results in closed continuous slot 13, having a stand wave, which has near maximums in its electric field component across the slot at both ends 24 and 26 of the rectangular shaped slot portion 14, and maximums at the midpoints of its sides defined by the length $W_S$. Those skilled in the art will recognize that this distribution of the electric field across the rectangular slot portion 14 result in a nearly omni-directional radiated electric field pattern (measured in the x-y plane for a z-directed or vertically polarized electric field), when $L_S$ is made approximately equal to $W_S$. If length $L_S$ is larger than width $W_S$ (as is the case for antenna 10, with $L_S$=90 mm, and $W_S$=60 mm), the radiated vertically polarized electric field increases in directions along the x-axis, and decreases in directions along the y-axis to become slightly less omni-directional.

It will also be understood that parallel slot sections 18 and 20 of the U-shaped slot portion 16 function as two parallel slot transmission lines feeding rectangular slot portion 14. Those skilled in the art will recognize the structure of the two parallel slot sections 18 and 20 to be that of a co-planar waveguide (CPW), which acts as a one-quarter wavelength impedance transformer for the rectangular shaped slot portion 14, when the length $L_F$ is selected to be approximately $\lambda_g/4$. The use of the co-planar waveguide not only provides a convenient way of feeding the rectangular slot portion 14 from the edge of antenna 10, but it enables the relatively high input impedance of the rectangular slot portion 14 to be transformed to a lower impedance to match that of coaxial cable 34. In this instance, coaxial cable 34 was a flexible type coax RG178, having a characteristic impedance of about 50 ohms. As is well known in the art, the slot width $S_F$, and the spacing $W_F$ of the parallel slot sections 18 and 20 can be modified to some degree for improving the match in impedance between coaxial cable 34 and antenna 10.

From the above discussion, it will be recognized that the rectangular slot portion 14 of the antenna 10 primarily functions as the radiating portion and defines the antenna radiation patterns, while the U-shaped slot portion 16 functions primarily as a feeding structure useful for antenna impedance matching.

Before leaving FIG. 1, it recognized that another embodiment of thin-film antenna 10 could be easily formed by reducing the length $L_F$ of the parallel slot sections 18 and 20 to zero. In doing so, the base slot section 22 then connects between the two ends 24 and 26 of the rectangular slot section 14 to form a continuous rectangular slot, with the cable feed points 30 and 32 now proximate opposite edges of the rectangular slot near the midpoint of one of the longer sides defined by the length $L_S$. This form of antenna is well know in the prior art as a side fed rectangular slot antenna.

Figure 2:
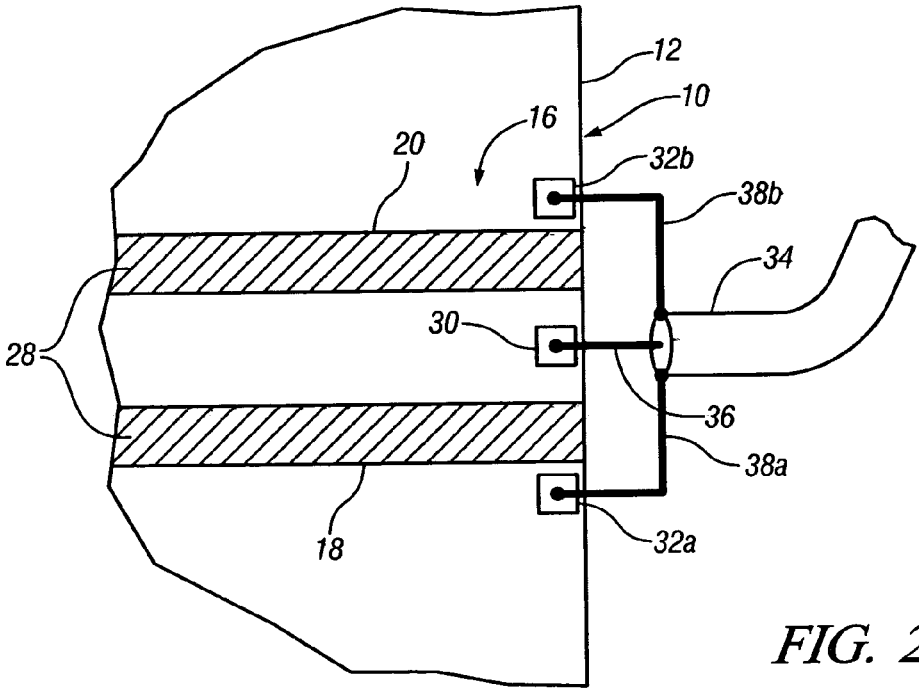
FIG. 2 is a plan view showing a portion of the transparent thin-film antenna of FIG. 1 with a different connecting structure for a coaxial cable.

FIG. 2 is a plan view showing a portion of thin-film antenna 10 having an alternative connecting structure for coaxial cable 34. Throughout the specification, the same numerals in different figures are used to denote like structures. In FIG. 2, parallel slot sections 18 and 20 are extended outwardly to an edge of the transparent thin-film conducting material 12. As described previously, the center conductor 36 of coaxial cable 34 is attached to feed point 30, which is located on the thin-film conducting material 12 approximately midway between parallel slot sections 18 and 20. Since the base slot section 22 is now absent, two outer feed points 32*a* and 32*b* are shown located proximate the outer edges of the slot line sections 18 and 20, near the peripheral edge of the surface of the thin-film conducting material 12. The shield or outer conductor of the coaxial cable 34 is then bifurcated into two parts 38*a* and 38*b*, each being respectively connected to outer feed points 32*a* and 32*b*. Note that in this configuration, the bifurcated parts of the shield conductor 38*a* and 38*b* act to close and electrically short the outer edges of parallel slot sections 18 and 20, thereby completing the formation of the U-shaped slot portion 16 for this embodiment.

Figure 3:
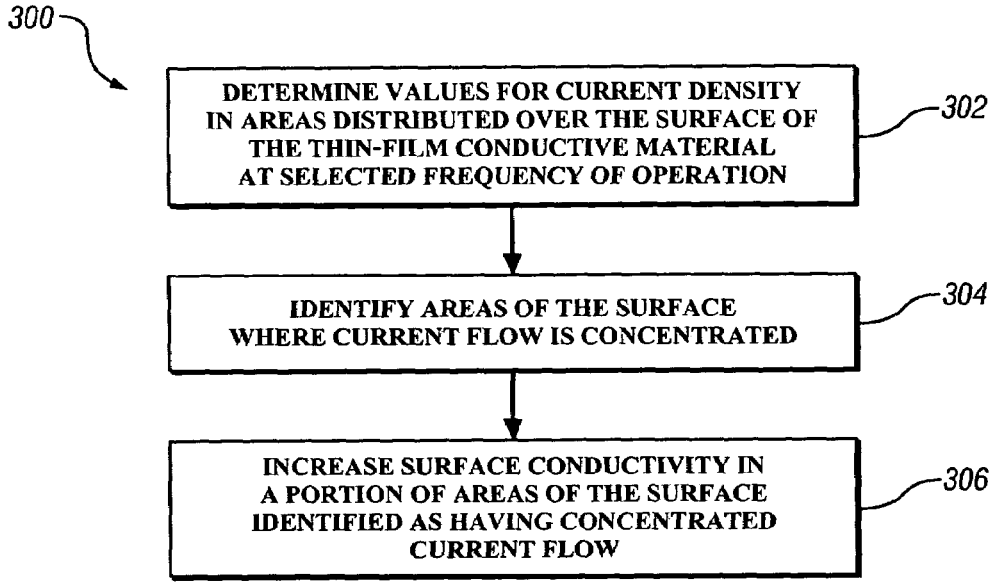
FIG. 3 is a flow chart broadly showing steps for carrying out the method of the present invention.

Turning now to FIG. 3, there is shown a flow chart 300, which broadly illustrates the steps involved in the method of the present invention for improving the efficiency of a transparent thin-film antenna. This method was applied to a half-scale version of the thin-film antenna 10 shown in FIG. 1, where each physical dimension was divided by two. As will be described later, this scaling was necessary to enable measurement of the radiation patterns of fabricated versions of the thin-film antenna 10 in the anechoic chamber available to the Applicants. Those skilled in the art will recognize that the distribution of current flow in the surface of such a half-scale antenna and the resulting radiation patterns will be the same as for the full-scale version of thin-film antenna 10 at frequencies having twice the value of those associated with the full-scale version. For example, the resonant frequency of 1.0 GHz described earlier for antenna 10 translated to a measured resonant frequency in the range of 2.0-2.2 GHz for the half-scale version.

For ease of discussion in the description that follows, the features of thin-film antenna 10 will continue to be used, with the understanding that the actual modeling and measurements were conducted on the half-scale version of the antenna 10.

The first step 302 is performed by determining values for current density distributed over areas of the surface of the of the transparent thin-film conducting material 12, due to current flow in the surface when the antenna is operated as a selected frequency.

The second step 304 involves identifying areas of the surface, where current flow is concentrated. The areas having concentrated current flow are identified based upon the values of current density determined at step 302.

The final step 306 is performed by increasing surface conductivity in a portion of the areas of the surface identified in step 304 as having concentrated current flow, thereby reducing ohmic loss in the surface.

Antenna efficiency is defined as the ratio $P_R/(P_R+P_L)$, where $P_R$ represents power radiated by an antenna, and the quantity $(P_R+P_L)$ represents the power input into an antenna, with $P_L$ representing power lost due to resistive heating in the antenna, i.e., ohmic loss. As a result, the efficiency of the thin-film antenna 10 is improved by performance of step 306 of the method, since the ohmic loss in the surface of the transparent thin-film material 12 is reduced.

By determining values for current density in areas distributed over the entire surface of the transparent thin-film conducting material 12 at step 302, the areas of the surface having concentrated current flow can be easily identified. As a result, the areas of the surface where conductivity is increased at step 306 can be limited to those areas having concentrated current flow. 302, the areas of the surface having concentration current flow is concentrated can be easily identified. As a result, the areas of the surface where conductivity is increased at step 306 can be limited to those areas having concentrated current flow.

It will be recognized that the above method can be applied to improve the efficiency of any type antenna having a surface formed of a transparent thin-film conductive material, such as patch type antennas, patch arrays, slot arrays, and the like.

The method is particularly useful for optically transparent antennas, where the transparency of the thin-film conducting material needs to be at least 70% for visible light. Since areas of the surface where conductivity is increased become less transparent, doing so in an ad hoc fashion can unnecessarily obstruct the optical view through the thin-film surface of the antenna. Without knowing the exact nature of the currents flowing on the entire surface formed of the transparent thin-film conducting material, the size of areas where conductivity is increased can become unnecessarily large. On the other hand, if surface areas having concentrated current flow are not recognized, and made more conductive, the resulting antenna will have a lower efficiency that otherwise could have been achieved.

Accordingly, the method of the present invention enables antenna efficiency to be increase in a more optimal and selective fashion, without unnecessarily obstructing the optical view through the transparent thin-film surface of the antenna. It will also be recognized that the method represented by the steps in the flow chart of FIG. 3 could be repeated at different selected frequencies, to improve antenna efficiency at multiple operating frequencies of antenna operation.

Figure 4:
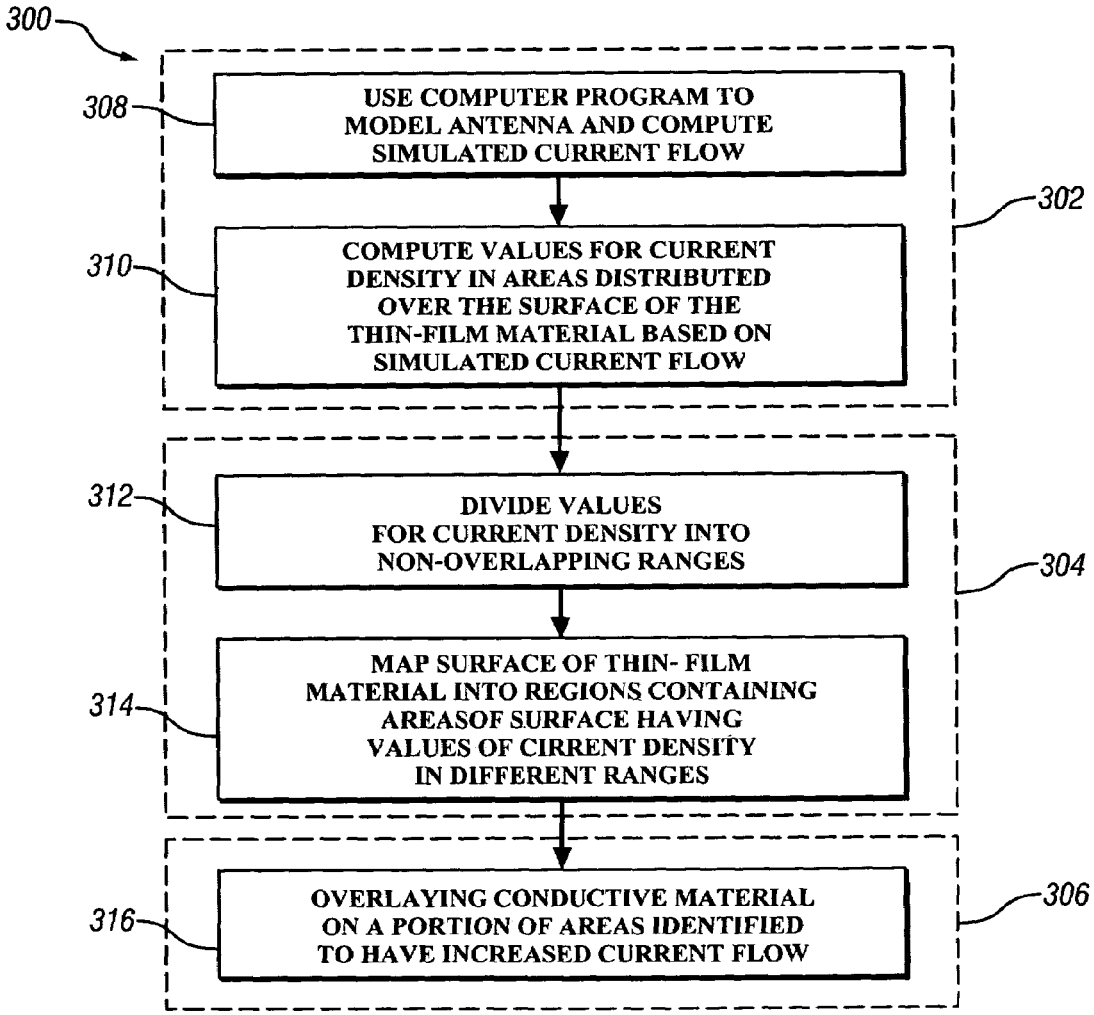
FIG. 4 is a flow chart showing additional preferred steps for carrying out the method of the present invention.

Turning now to FIG. 4, there is shown a flow chart with a further breakdown of the preferred steps for carrying the method of the present invention. The general steps 302, 304, and 306 in the flow chart of FIG. 3, are preferably carried out by performance of the steps 308, 310, 312, 314, and 316 shown in FIG. 4.

At step 308, the values for current density distributed in areas over the surface of the transparent thin-film conducting material 12 are preferably determined by computing simulated current flow in the surface using a computer program. Many computer programs capable of performing electromagnetic analysis are commercially available, and could be used in the present method; however, the FEKO program marketed by EM Software & Systems (Stellenbosch, South Africa) was selected for use in the preferred embodiment. The FEKO program is a full wave, method of moments (MoM) based computer code for the analysis of general electromagnetic problems. Wire grid structures are used to model antennas, and simulated sources of electromagnetic excitation are applied to the wire grid structures to excite simulated current flow in wire segments making up the wire grid structures.

Figure 5:
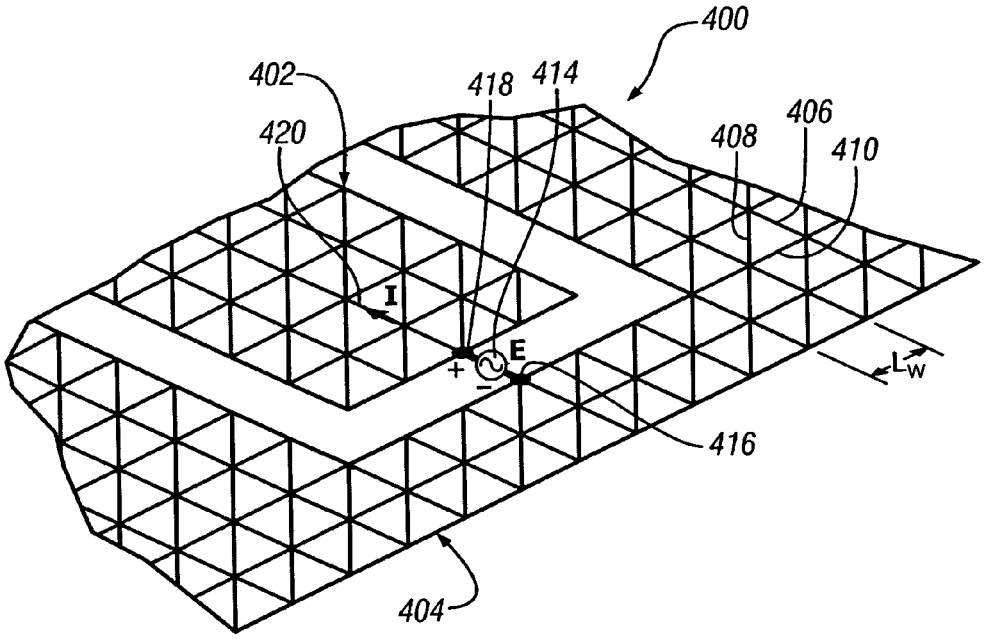
FIG. 5 shows a portion of a wire grid model for a half-scale version of thin-film antenna 10 near its feed points.

For purposes of illustration, FIG. 5 shows a portion of a wire grid model, generally designated as 400, for the half-scaled version of thin-film antenna 10 near its feed points. The surface formed of the transparent thin-film conducting material 12, with the aperture formed by closed continuous slot 13, is represented by wire grid structures 402 and 404. These wire grid structures 402 and 404 are comprised of a plurality of interconnected wire segments, such as denoted by the numerals 406, 408, and 410, which form one triangle of the mesh of the wire grid structure 404. Those familiar with the FEKO program will understand that wire grids having rectangular, triangular, and other shaped mesh structures can also be use when modeling antennas.

The wire grid structures 402 and 404 are given the same dimensions as the actual surface being modeled, with the length of each wire segment $L_W$ selected to be in the range of about $\lambda_g/10 \leqq L_W \leqq \lambda_g/12$, where as previously discussed, $\lambda_g=\lambda_o/(\text{square root of } \epsilon_r)$ represents the guided wavelength of waves propagating along closed continuous slot 13 in the presence of the dielectric medium for the selected operating frequency $f_A$.

A simulated source of electromagnetic excitation 414 is applied to the wire grid structures 402 and 404 at the points 418 and 416, which represent the feed points 30 and 32 of thin-film antenna 10. For this application, a sinusoidal voltage source E acts as the simulated source of electromagnetic excitation 414. The voltage E of source 414 can be varied at any selected frequency $f_A$ in simulating the operating the half-scaled version of thin-film antenna 10. For the present application, the frequency of operation of the model was selected to be $f_A$=2.2 GHz, which is near a resonance of the half-scale version of antenna 10, which corresponds to approximately twice the actual 1.0 GHz resonance of the full-scale version of antenna 10. It will be recognized that the voltage source 414 excites current flow in the plurality of wire segments forming the wire grid structures 402 and 404. This is shown exemplarily by the simulated current I flowing in wire segment 420 in FIG. 5. This simulated current flow in the wire grid model is representative of the currents flowing in the surface of the thin-film conducting material 12 of antenna 10.

The FEKO computer program computes the simulated current flow in each wire segment of the wire grid structures. 402 and 404 based upon the source of excitation, and the mutual electromagnetic couplings between the wire segments. This is accomplished by obtaining a numerical solution to Maxwell's equations for the modeled antenna structure 400 using a technique know as the method of moments. Of course, those skilled in the art will understand that such a numerical solution could be obtained by other well-known methods such as finite element method (FEM), or finite difference time domain (FDTD) techniques.

The FEKO program also allows for a resistive value to be assigned to each wire segment to account for ohmic loss in surfaces being modeled. For the present application, each wire segment was given a conductivity value of about $2\times10^6$ S/m to account for the 4.5 ohms/square surface resistivity of AgHT™-4 film used in fabricating thin-film antenna 10. The FEKO program also includes options for accounting for the presence of the dielectric layers in antenna. In this case, the dielectric quboid (QU-control card) option was used in modeling the dielectric layer 28.

Figure 6:
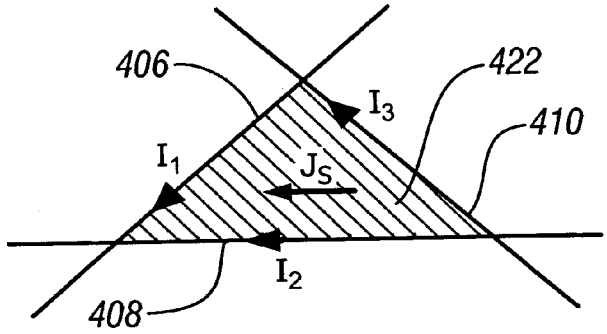
FIG. 6 shows wire segments forming one triangle in a mesh of a wire grid model representing an area of the surface of a half-scale version of thin-film antenna 10.

At the next step 310 in the flow chart of FIG. 4, values for current density distributed in areas over the surface of the transparent thin-film conducting material 12 are computed based upon the simulated current flow in the model computed in step 308. The FEKO program automatically computes values of current density for areas of a surface modeled by wire grid structures 402 and 404. The technique used differs depending upon the type of wire grid mesh used to model a surface. For example, FIG. 6 illustrates a portion of wire grid structure 404 with wire segments 406, 408, and 410 connected to form a triangle of the mesh in the wire grid model, which represents an area 422 of the modeled surface. The simulated currents $I_1$, $I_2$, and $I_3$ are shown flowing through respective wire segments 406, 408, and 410. The FEKO program computes a value for the current density $J_S$ (amperes/square meter) for the area 422 based upon simulated currents $I_1$, $I_2$, and $I_3$ apportioned between adjoining triangular surface areas of the modeled surface. In a like fashion, the FEKO program computes values for current density $J_S$ for each area of the surface of the transparent thin-film conducting material 12 modeled by the wire grid structures 402 and 404.

At step 312 in the flow chart of FIG. 4, the computed values for the current densities $J_S$ for areas distributed over the surface of the transparent thin-film conducting material 12 are divided into non-overlapping ranges of values. Then at step 314, the surface of the thin-film material 12 is mapped into regions, where each region contains areas having values of current density $J_S$ in one of the non-overlapping ranges of values. Again, the FEKO program does this automatically. Typically, each of the non-overlapping ranges of values for the current densities $J_S$ are assigned a color selected from shades of red, yellow, green and blue. The FEKO program then provides a colored display of the surface having regions mapped in the different assigned colors, where each region contains areas of the surface having current densities in the range of values assigned to that color.

Although a colored display of surfaces having values of current density $J_S$ mapped in this fashion is preferable, due to the difficulty associated with providing colored figures in the specification, this procedure will be now be described by use of FIG. 7, which shows a black and white shaded representation of the mapped surface for half-scaled version of thin-film antenna 10. It should be noted that FIG. 7 is not as accurate as the actual colored mapping of the surface provided by the FEKO program, and is being used merely to facilitate an explanation of the operations of the FEKO program in this respect.

For purposes of illustrating this aspect of operation of the FEKO computer program, the computed values of current density $J_S$ determined as step 310 were divided into the following non-overlapping ranges of values: Range A ($J_S$>16.2); Range B (16.2≧$J_S$>11.3); Range C (11.3≧$J_S$>3.8); Range D (3.8≧$J_S$>2.7); and Range E (2.7≧$J_S$).

Figure 7:
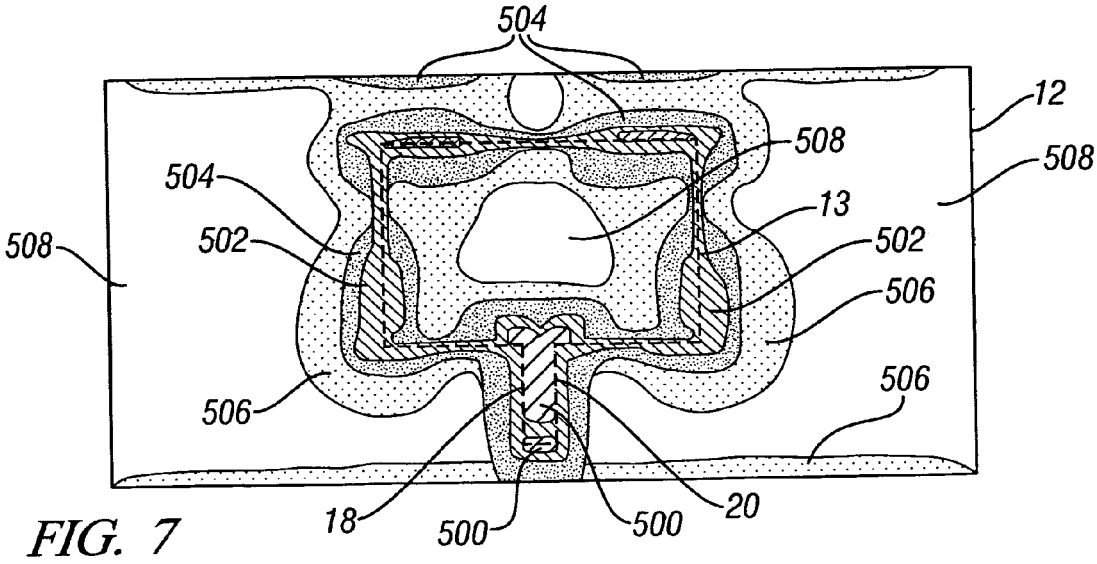
FIG. 7 shows a mapping of the surface of a transparent thin-film conducting material of a half-scale version of antenna 10 into regions containing areas of the surface having values of current density in different ranges of values.

FIG. 7 illustrates a mapping of above regions with different shading onto the surface of formed of the transparent thin-film conducting material 12 of the half-scale version of thin-film antenna 10, but also applies to the full-scale version of antenna 10 operated at a frequency near 1.0 GHz. The closed continuous slot 13 is shown as a dotted line so as not to obscure the drawing. Each region contains areas of the surface having values of surface current density in the respectively assigned non-overlapping ranges of values. In FIG. 7, Regions A, B, C, D, and E are respectively denoted by the numerals 500, 502, 504, 506, and 508. Region A contains areas of the surface having the largest values of current density, and is located near feed points 30 and 32, and edges of the slots forming the two parallel slot sections 18 and 20. Region B contains the next largest range of values for the current density, and areas of the surface contained in this regions are proximate the inner and outer edges of the entire slot forming closed continuous slot 13. Thus, regions containing areas having the larger values of current density identify areas of concentrated current flow on the surface of the transparent thin-film conducting material 12 of the half-scaled version of thin-film antenna 10.

Figure 8:
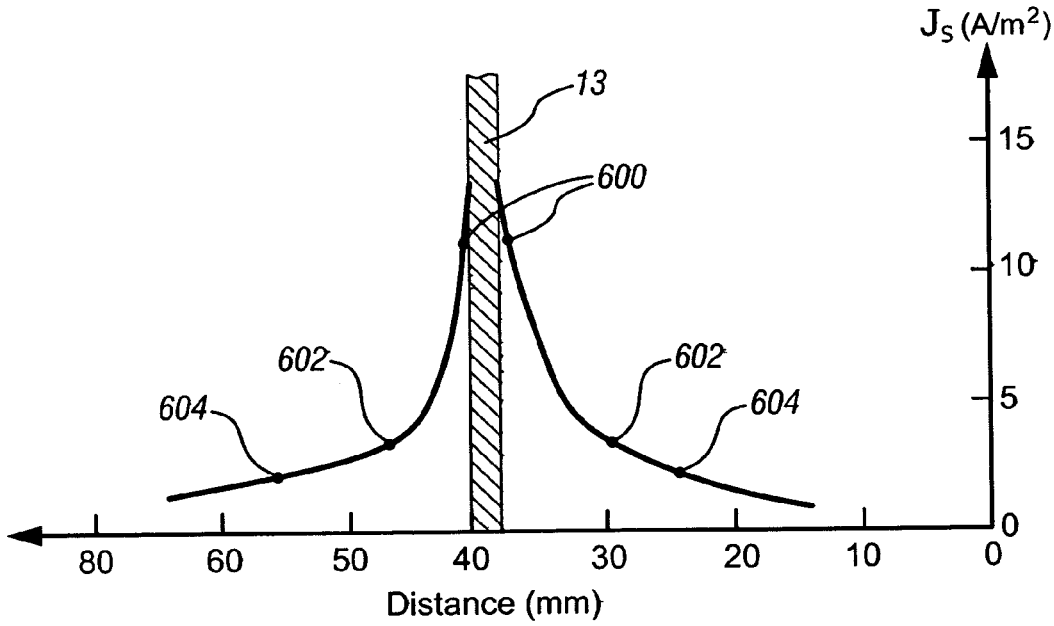
FIG. 8 shows graph of current density $J_S$ for areas of the surface of the transparent thin-film conducting material of antenna 10 along the x-axis defined in FIG. 1.

It will be understood that the broadening of each successive region in directions along the surface away from the edges of the closed continuous slot 13 indicates a rapid decrease in current flow in these regions. This is shown by the graph of FIG. 8, which provides a plot of surface current density $J_S$ for areas of the surface of the thin-film conducting material 12, along the x-axis defined in FIG. 1. The solid dots on the curve represent boundaries between mapped regions, i.e., the solid dots 600 represent boundary points between Regions B and C; the solid dots 602 represents boundary points between Regions C and D, and the solid dots 604 represent the boundary points between Regions D and E, as translated to the full-scale dimensions of antenna 10. The shaded region 13 represents the location of the edges of the slot forming closed continuous slot 13 along the x-axis. The values of current density $J_S$ decrease in an exponential fashion as distance from the slot edges increases. Within just a few millimeters from the edges of slot along the x-axis, the value of $J_S$ decreases to about one-half of its value, which would be about 6 dB decrease from a power perspective.

Having mapped of the surface of the transparent thin-film conducting material 12 into regions as described above, the identified areas having concentrated current flow for the half-scale thin-film antenna 10 are those areas of the surface adjacent to, and in close proximity with the edges of the closed continuous slot 13.

Returning to FIG. 4, the last step 316 in the flow chart provides for overlaying conductive material on a portion of those areas of the surface of the thin-film conducting material 12 identified as having concentrated current flow. Preferable, the conductivity of the surface is increased in identified areas by overlaying those areas with conducting material to decrease the surface resistivity. This can be accomplished any number of ways, for example, by depositing additional conducting material onto portions of the identified areas of the surface, by vapor deposition, thick film printing, by attaching conducting strips or wires of conductive material to the surface with conductive adhesive, or by manually pasting conducting material onto the surface. Of course, materials having greater conductivity are preferable since such material can be applied to the surface in thinner layers.

Figure 9:
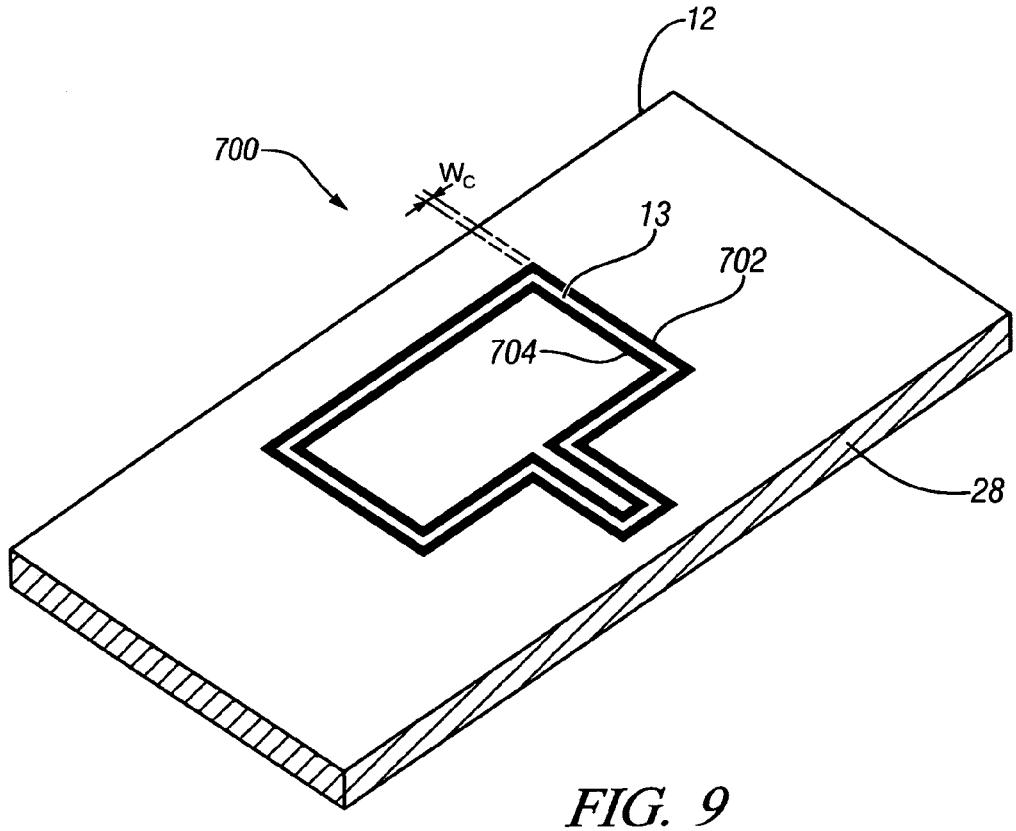
FIG. 9 shows a perspective view of a half-scale version of antenna 10 with additional metallization applied to areas of its thin-film surface to improve antenna efficiency.

Turning now to FIG. 9, there is shown an antenna 700 to which the method of the present invention has been applied. The structure of antenna 700 is identical to that of the half-scale version of thin-film antenna 10, except that conductive metallization layers 702 and 704 have been applied to overlay the areas of the thin-film surface 12, which were previously identified as having concentrated current flow, i.e., areas adjacent to and surrounding the edges of the closed continuous slot 13. For this application, the width $W_C$ of the narrow conductive strips of metallization was about 0.5 to 1.0 mm for the half-scale version of antenna 700. It will be understood that this would translate to a width of about 1.0 to 2.0 mm for the full-scale version of antenna 700. The metallization consisted of a highly conductive silver epoxy material, which was overlaid by manually pasting the electrically conducting material onto surface 12. Because the elongated strips 702 and 704 are quite narrow, the optical view through antenna 700 is not significantly obstructed.

Figure 10:
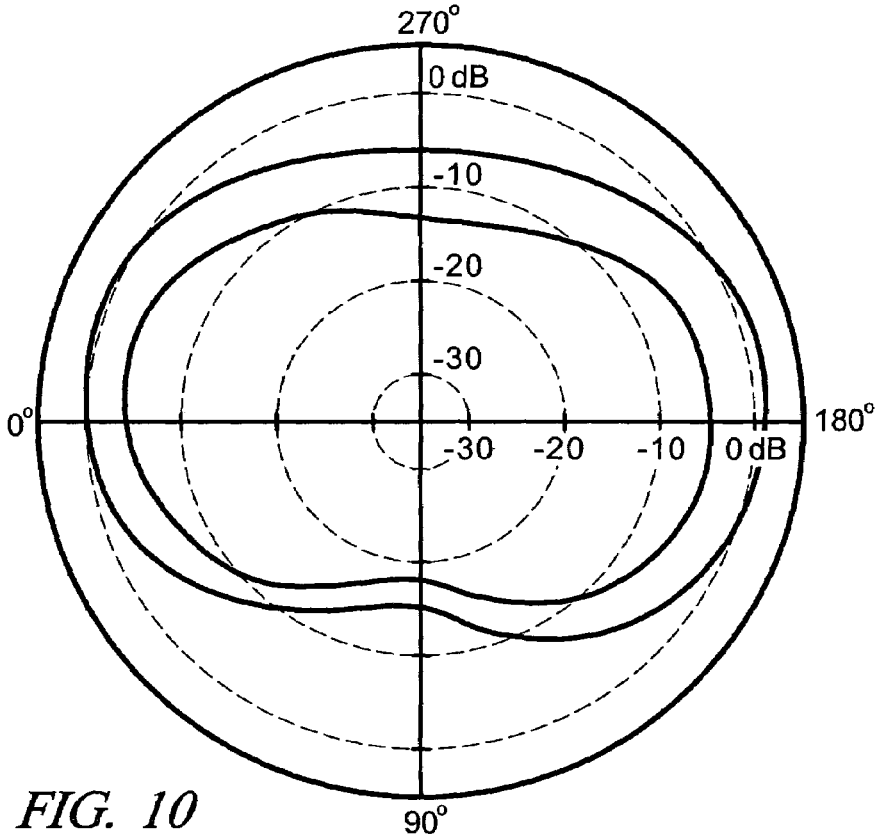
FIG. 10 shows a polar plot of measured radiation gain patterns for the half-scale antennas of FIGS. 1 and 9, illustrating the improvement in antenna gain achieved by the application of the present invention.

FIG. 10 shows a polar plot of measured radiation patterns for the half-scale versions of thin-film antenna 10, and antenna 700. As indicated previously, it was necessary to use half-scale versions of these antennas in order to make use of an anechoic chamber at the Applicants' antenna measurement facility, which utilized electromagnetic absorbing material only useful for frequencies above 1 GHz. Those skilled in the art will recognize that measured radiation patterns obtained for antennas scaled to one-half of their dimensions at twice the value of a measurement frequency will be the same as radiation patterns measured for full-scale antennas operated without doubling the measurement frequency. These patterns represent the gain of the antennas measured in the far field of the x-y plane (see FIG. 1) for an electric field polarized in the z-direction. The x-axis aligns with the 0-degree point on the polar plot, with the y-axis aligned with the 90-degree point. The radiation pattern represented by the dashed line represents the gain of the half-scale version of thin-film antenna 10, while the sold line represents the gain of the half-scale version of antenna 700. As indicated by a comparison of these patterns, the addition of the metallization layers 702 and 704 to antenna 700 results in an increase in antenna gain of about 3-6 dB due to the improved efficiency of antenna 700. Additional radiation pattern measures were taken at selected frequencies of 1.7, 1.8, 1.9, 2.0, and 2.1 GHz showed similar improvements in the efficiency and gain of antenna 700 resulting from the application of the present invention. Again, these results would be the same for the full-scale version of antenna 700, where the electrically conducting material applied to the thin-film surface 12 in elongated strips having widths $W_C$ of about 1.0 to 2.0 mm.

Figure 11:
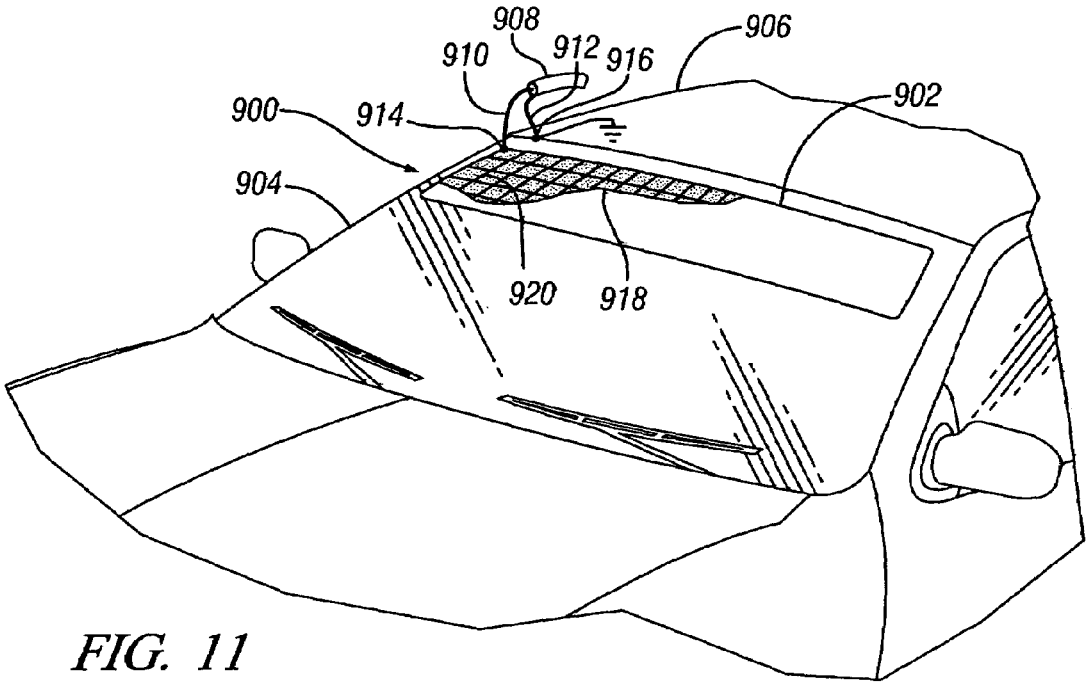
FIG. 11 shows a thin-film antenna in a vehicle windshield application, where a mesh of thin conducting elements is overlaid on areas of the surface to increase the conductivity.

One last embodiment is shown by way of FIG. 11 to illustrate the application of method of the present invention to a patch type thin-film antenna 900 comprising a patch formed of a transparent thin-film conducting material 902 disposed on windshield 904 of a motor vehicle 906. Techniques for mounting antenna 900 to or inside the glass layers of windshield 904 are well known in the art.

For the purposes of illustration, antenna 900 is shown fed by coaxial cable 908 having its center conductor 910, and shield conductor 912, attached respectively to antenna feed points 914 and 916. The feed point 916 is located on the metal portion of the vehicle 906 to provide a ground point.

If for example, the excitation of antenna 900 produces concentrated current flow in a region of its surface designated by the numeral 918, this region would represent a significant portion of areas of the surface of antenna 902. If conducting material was applied to overlay all areas of the surface 902 within region 918, this would undesirably obstruct the optical view through antenna 900, and the windshield 904.

For this type of application, the conducting material can be applied in the form of a conducting mesh to overlay portions of those surface areas in region 918, which have been identified as having concentrated current flow. The mesh can be made of highly conductive materials such as copper, silver, or gold, and can take the form of narrow strips of material, or thin interconnected wires deposited or overlaid onto surface 902. As is know in the art, such conductive mesh structures behave similar to solid conducting sheets, if the spacing of the openings in the mesh are less that about one-tenth of a wavelength at the highest desired operating frequency of antenna 900. Thus, this type of mesh structure can be used to increase the conductivity of identified areas the surface where current flow is concentrated, without undesirably obstructing the optical view through the antenna.

Accordingly, the method of the present invention can be applied to improve the efficiency a variety of different transparent thin-film antennas have different forms and structures, without undesirably obstructing the optical view through the surface of the antennas.

The foregoing discussion discloses and describes the preferred embodiment for carrying out the method of the present invention, and improved antenna structures resulting from the application of the method. While the invention has been described by reference to certain preferred embodiments and implementations, it should be understood that numerous changes could be made within the spirit and scope of the inventive concepts described. Accordingly, it is intended that the invention not be limited to the disclosed embodiments, but that it have the full scope permitted by the language of the following claims:

The invention claimed is:

1. An antenna comprising:

a surface formed of a transparent thin-film conducting material, the surface having areas in which current flows as a result of the antenna being operated at a desired frequency; and electrically conductive material overlaying and on a portion of identified areas of the surface having concentrated current flow, the identified areas being determined based upon computed values of current density in areas distributed over the surface formed of the thin-film conducting material, wherein such electrically conductive material decreases surface resistivity of such portion of the identified areas of the surface to provide improved antenna efficiency.

2. The antenna of claim 1, wherein the computed values of current density are determined by modeling the antenna.

3. The antenna of claim 1, wherein the electrically conductive material forms strips overlaying and on a portion of the identified areas of the surface.

4. The antenna of claim 1, wherein the electrically conductive material forms a mesh of conductive elements overlaying and on a portion of the identified areas of the surface.

5. The antenna of claim 1, wherein the surface formed of the transparent thin-film conducting material contains an aperture formed by a continuous closed slot.

6. The antenna of claim 1, wherein the surface formed of the transparent thin-film conducting material has a transparency to visible light of at least 70%.

7. The antenna of claim 1, wherein the surface formed of the transparent thin-film conducting material contains an aperture formed by a slot having edges, where the identified areas of the surface having concentrated current flow are adjacent to the edges of the slot.

8. The antenna of claim 5, wherein the slot includes an essentially rectangular shaped portion with two ends near a midpoint of a side, each of the two ends opening outwardly away from the rectangular shaped portion into a different one of two parallel slot sections.

9. The antenna of claim 8, wherein each of the two parallel slot sections have an open end at a peripheral edge of the surface made of the transparent thin-film conductive material.

10. The antenna of claim 8, wherein the two parallel slot sections each have an end opening into a different one of two ends of a base slot section, the two parallel slot sections and base slot section essentially forming a U-shaped slot portion.

11. An antenna comprising:

a surface formed of a transparent thin-film conducting material, the surface having areas in which current flows as a result of the antenna being operated at a desired frequency; and electrically conductive material overlaying and on identified areas of the surface having concentrated current flow, the identified areas representing defined regions of the surface having current density values larger than current density values for areas of the surface outside the defined regions, wherein the electrically conductive material decreases surface resistivity of the transparent thin-film conducting material in the identified areas, thereby reducing ohmic loss and improving antenna efficiency.

* * * * *